US007450092B2

(12) United States Patent
Kim et al.

(10) Patent No.: US 7,450,092 B2
(45) Date of Patent: Nov. 11, 2008

(54) ORGANIC LIGHT-EMITTING DEVICE

(75) Inventors: Byeong Koo Kim, Gyeongsangbuk-do (KR); O Hyun Kim, Gyeongsangbuk-do (KR); Young Ju Park, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 696 days.

(21) Appl. No.: 11/002,197

(22) Filed: Dec. 3, 2004

(65) Prior Publication Data

US 2005/0243076 A1 Nov. 3, 2005

(30) Foreign Application Priority Data

Apr. 30, 2004 (KR) ..... 10-2004-0030445

(51) Int. Cl.
*G09G 3/30* (2006.01)

(52) U.S. Cl. ..... 345/76; 345/82; 315/169.1

(58) Field of Classification Search ..... 345/76–83; 315/169.1–169.4

See application file for complete search history.

(56) References Cited

U.S. PATENT DOCUMENTS

| | | | | |
|---|---|---|---|---|
| 2002/0012151 | A1* | 1/2002 | Feng | 359/180 |
| 2005/0023991 | A1* | 2/2005 | Kemper | 315/291 |
| 2005/0068271 | A1* | 3/2005 | Lo | 345/76 |
| 2005/0093783 | A1* | 5/2005 | Lau et al. | 345/76 |
| 2005/0206591 | A1* | 9/2005 | Wang et al. | 345/76 |

* cited by examiner

*Primary Examiner*—Richard Hjerpe
*Assistant Examiner*—Kimnhung Nguyen
(74) *Attorney, Agent, or Firm*—Birch, Stewart, Kolasch & Birch, LLP

(57) ABSTRACT

An organic light-emitting device includes a first transistor for applying a data voltage; a second transistor for applying a driving current depending on the data voltage and an initiation voltage to an organic light-emitting diode; a third transistor for generating a threshold voltage; a fourth transistor for applying an initiation voltage, the fourth transistor being connected to the third transistor; a fifth transistor for applying a power voltage; and a condenser provided between a first node connected to the third and fifth transistors and a second node connected to the first and second transistors, for maintaining the power voltage and the threshold voltage for compensation.

40 Claims, 15 Drawing Sheets

ORGANIC LIGHT-EMITTING DEVICE

This Nonprovisional application claims priority under 35 U.S.C. § 119(a) on Patent Application No(s). 10-2004-0030445 filed in KOREA on Apr. 30, 2004, the entire contents of which are hereby incorporated by reference.

BACKGROUND OF THE INVENTION

1. Field of the Invention

The invention pertains to an organic light-emitting device, and more particularly, to an organic light-emitting device that prevents a stripe pattern caused by device irregularities and a power voltage drop, and improves the aperture ratio.

2. Description of the Related Art

Generally, an organic light-emitting device is a self-emissive display device that emits light by electrically exciting a luminous organic compound. The organic light-emitting device can drive an N×M number of organic light-emitting diodes (OLEDs) to display an image.

Driving the organic light-emitting device occurs in a passive matrix manner or in an active matrix manner using a transistor. The organic light-emitting device using the passive matrix manner is driven with an anode vertical to a cathode and a selection line. In comparison to the passive matrix driving, the organic light-emitting device using the active matrix is driven with a transistor and a condenser connected to each ITO (indium tin oxide) pixel electrode to maintain a voltage by the condenser capacitance.

FIG. 1 illustrates a pixel of a related art active matrix organic light-emitting device, and typically illustrates one of the N×M pixels.

The related art active matrix organic light-emitting device of FIG. 1 includes a second transistor M2 being connected to the organic light-emitting diode (OLED) to supply current for luminescence, and the amount of current in the second transistor M2 is controlled by a $m^{th}$ data voltage (Data[m]) applied through a first transistor M1. A condenser C1 connects between a source electrode and a gate electrode of the second transistor M2 to maintain the applied $M^{th}$ data voltage for a predetermined period. A gate line connects to the gate electrode of the first transistor M1 to supply an $n^{th}$ selection signal (Select[n]), and a data line is connected to the source electrode to supply an $m^{th}$ data voltage (Data[m]).

The operation of the above organic light-emitting device is described as follows. If the first transistor M1 is turned on by the $n^{th}$ selection signal (Select[n]) applied to a gate electrode of the first transistor M1, the $m^{th}$ data voltage (Data[m]) is applied to the gate electrode (node A) of the second transistor M2. Accordingly, the organic light-emitting diode (OLED) emits light by the driving current provided through the second transistor M2. That is, after the $n^{th}$ selection signal (Select [m]) is used to select a desired pixel, the organic light-emitting diode (OLED) emits light by the driving current flowing from the second transistor M2 generated by the applied $m^{th}$ data voltage (Data[m]).

The above-described organic light-emitting device is manufactured through the process shown in FIG. 2. As shown in FIG. 2, laser power outputted from an excimer laser is used to crystallize an amorphous silicon (a-Si) substrate into a polysilicon (p-Si) substrate. At this time, several variables determine the quality of the polysilicon. In particular, the polysilicon substrate has qualities sensitive to the laser power outputted from the excimer laser. That is, the excimer laser has unstable laser power strength depending on time. Accordingly, the crystallized polysilicon substrate has an unstable, i.e., variable, quality.

The amorphous substrate is crystallized into the polysilicon substrate by unidirectionally irradiating the laser power into the amorphous substrate (that is, using one scan direction). The polysilicon substrate has an irregular characteristic in the scan direction, but has a regular characteristic in a direction vertical to the scan direction.

If the polysilicon substrate has an irregular characteristic, a threshold voltage (Vth) of the manufactured driving transistor (for example, second transistor M2 of FIG. 1) becomes variable. Accordingly, the threshold voltages of the driving transistors provided at respective pixels are different from one another, thereby causing current flowing the driving transistors to be different from one another. As a result, there is a drawback in that the desired grayscale and uniformity cannot be obtained.

If the crystallized polysilicon substrate is driven irregularly, the displayed image has a stripe pattern as shown in FIG. 3. This is caused by the variation of the threshold voltage of the driving transistor due to the irregularity of the crystallized substrate.

In the meantime, organic light-emitting devices have been vigorously studied for large-area driving together with other flat panel display devices.

In this application, the power voltage (Vdd) is applied to each pixel. The power voltage is generally applied to a lower side from an upper side of a panel. The power voltage is applied along the power line. Since the power line has an internal line resistance, a power voltage lower than that of the upper side of the panel is applied at the lower side due to the voltage drop (IR-drop). Since the lower power voltage is applied at the lower side than the upper side of the panel due to the voltage drop (IR-drop), there is a drawback in that the driving current relating to the power voltage is reduced, thereby not providing the desired grayscale.

SUMMARY OF THE INVENTION

Accordingly, the invention pertains to an organic light-emitting device that substantially obviates one or more problems due to limitations and disadvantages of the related art.

An object of the invention is to provide an organic light-emitting device in which a transistor array structure of a pixel is improved to prevent a stripe pattern and a voltage drop, thereby improving a picture quality.

Another object of the invention is to provide an organic light-emitting device for improving an aperture ratio by connecting an improved transistor to several pixels.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

The invention, in part, pertains to an organic light-emitting device that includes a first transistor for applying a data voltage; a second transistor for applying a driving current depending on the data voltage and an initiation voltage to an organic light-emitting diode; a third transistor for generating a threshold voltage; a fourth transistor for applying the initiation voltage, the fourth transistor being connected to the third transistor; a fifth transistor for applying a power voltage; and a condenser provided between a first node connected to the third and fifth transistors and a second node connected to the first and second transistors, for maintaining the power voltage and the threshold voltage for compensation.

In the invention, the driving current can be determined by a difference between the data voltage and the initiation voltage. The threshold voltage can be maintained by the condenser compensates a threshold voltage of the second transistor. The power voltage can be maintained by the condenser compensates a power voltage applied to the second transistor. The first to fourth transistors can be PMOS transistors, the fifth transistor can be an NMOS transistor, the fourth and fifth transistors are complementarily controlled by a first selection signal, and the first transistor is controlled by a second selection signal. Also, the first to fifth transistors can be PMOS transistors, and the first, fourth and fifth transistors are controlled by different selection signals. Further, the first to fourth transistors can be PMOS transistors, and the fifth transistor is then an NMOS transistor, the first and fourth transistors are controlled by the first selection signal, the fifth transistor is controlled by the second selection signal, and the first and second selection signals are at the same voltage level. Also, the first to fifth transistors can be PMOS transistors, the first and fourth transistors are controlled by the first selection signal, the fifth transistor is controlled by the second selection signal, and the first and second selection signals are at different voltage levels.

A second aspect of the invention, in part, pertains to an organic light-emitting device including a first transistor for applying a data voltage; a second transistor for applying a driving current depending on the data voltage and an initiation voltage to an organic light-emitting diode; a third transistor for generating a threshold voltage; a fourth transistor for applying the initiation voltage, the fourth transistor being connected to the third transistor; a fifth transistor for applying a power voltage; a condenser provided between a first node connected to the third and fifth transistors and a second node connected to the first and second transistors, for maintaining the power voltage and the threshold voltage for compensation; and a sixth transistor connected between the second transistor and the organic light-emitting diode, for cutting off a high current flowing to the organic light-emitting diode during a reset period for which the second node is initialized.

A third aspect of the invention, in part, pertains to a organic light-emitting device that includes a first transistor for applying an initiation voltage; a second transistor for applying a power voltage; a third transistor connected to the first transistor, for generating a threshold voltage; a first node connected to the second and third transistors; and at least two pixels connected to the first node, wherein each pixel includes: a fourth transistor for applying a data voltage; a fifth transistor for applying a driving current depending on the data voltage and the initiation voltage to an organic light-emitting diode; and a condenser connected between the first node and a second node connected to the fourth and fifth transistors, for maintaining the power voltage and the threshold voltage for compensation.

A fourth aspect of the invention, in part, pertains to an organic light-emitting device that includes a first transistor for applying an initiation voltage; a second transistor for applying a power voltage; a third transistor connected to the first transistor, for generating a threshold voltage; a first node connected to the second and third transistors; and at least two pixels connected to the first node, wherein each pixel includes: a fourth transistor for applying a data voltage; a fifth transistor for applying a driving current depending on the data voltage and the initiation voltage to an organic light-emitting diode; a condenser connected between the first node and a second node connected to the fourth and fifth transistors, for maintaining the power voltage and the threshold voltage for compensation; and a sixth transistor connected between the fifth transistor and the organic light-emitting diode, for cutting off a high current flowing to the organic light-emitting diode during a reset period for which the second node is initialized.

In the first to fourth embodiments of the invention, the driving current can be determined by a difference between the data voltage and the initiation voltage. Accordingly, the driving current has no relation with the power voltage and the threshold voltage, thereby providing a regular picture quality at each of pixel and at all of an upper side and a lower side of a panel.

In the first to fourth embodiments of the invention, the second transistor can have a threshold voltage compensated by the threshold voltage, which is generated by the third transistor to be maintained by the condenser.

Further, the second transistor has a power voltage compensated by the power voltage, which is applied to the fifth transistor to be maintained by the condenser.

The invention, in part, pertains to a light-emitting device that includes at least one diode; and a circuit, the circuit inputting a data voltage (Vdata) and an initiation voltage (Vin), the circuit outputting I, wherein $I=K(Vdata-Vin)^2$ where K is a constant.

The invention, in part, pertains to a driving circuit for an organic light-emitting device that includes a first transistor for applying a data voltage; a second transistor for applying a driving current depending on the data voltage (Vdata) and an initiation voltage (Vin) to an organic light-emitting diode; a third transistor for generating a threshold voltage; a node connected to the second and third transistors; and a condenser connected to the node.

It is to be understood that both the foregoing general description and the following detailed description of the invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the preferred embodiments of the invention, examples of which are illustrated in the accompanying drawings.

Figure 1:
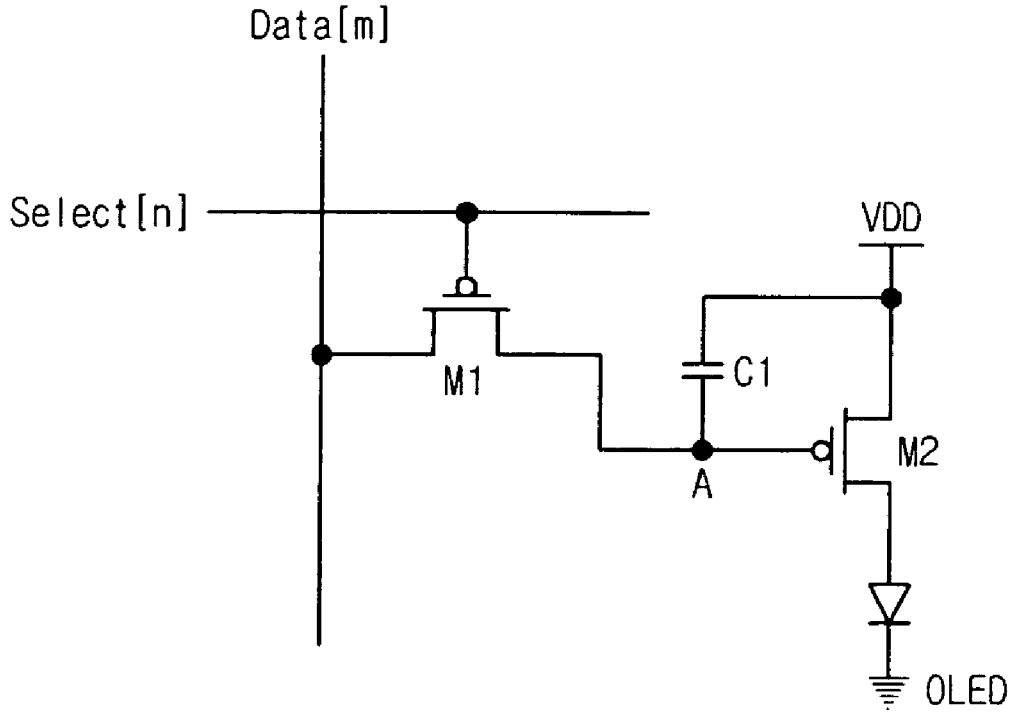
Fig.1 Related Art
FIG. 1 illustrates a pixel of a related art active matrix organic light-emitting device.
Figure 2:
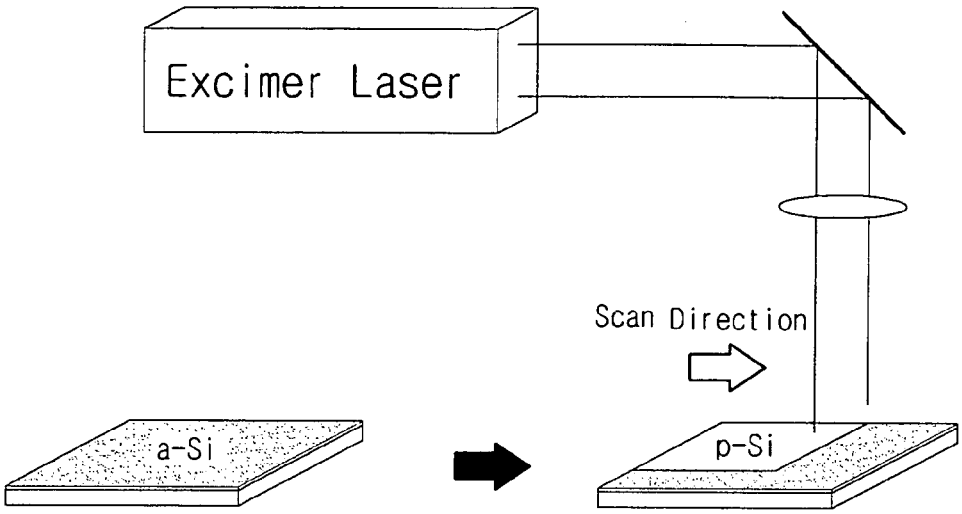
Fig.2 Related Art
FIG. 2 illustrates a process of manufacturing an organic light-emitting device.
Figure 3:
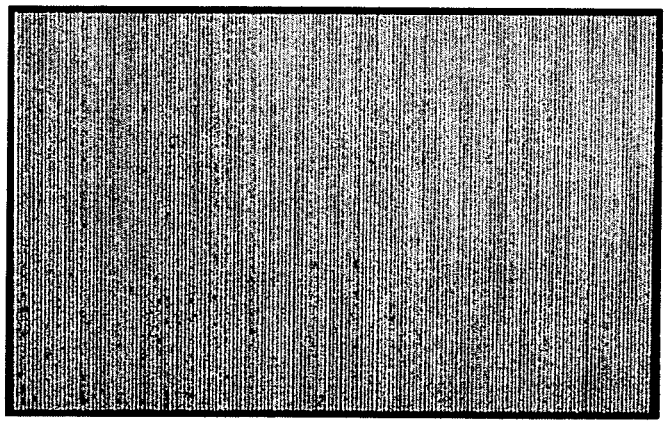
Fig.3 Related Art
FIG. 3 illustrates a stripe pattern caused by an irregularly crystallized polysilicon film.
Figure 4:
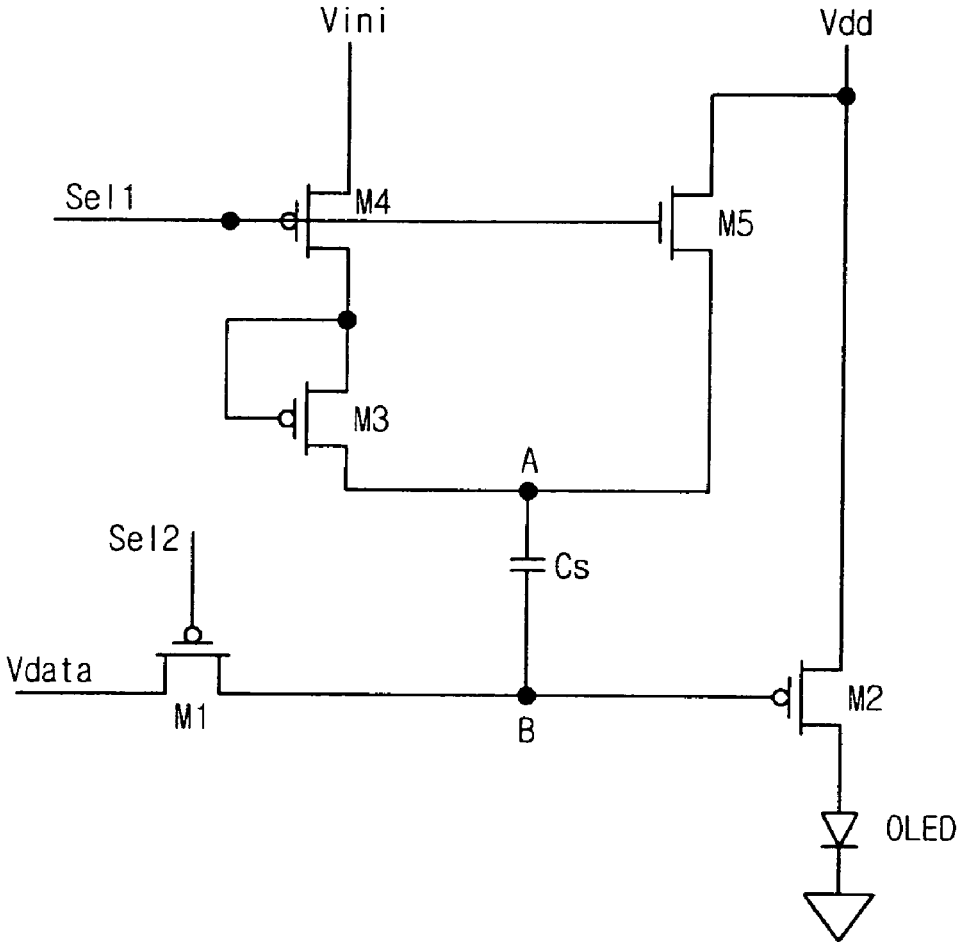
FIG. 4 illustrates a pixel of an organic light-emitting device according to a first embodiment of the invention.

FIG. 4 illustrates a pixel of an organic light-emitting device according to a first embodiment of the invention, which typically illustrates one of the N×M pixels.

Referring to FIG. 4, the inventive organic light-emitting device complementarily supplies a first selection signal (Sel1) to each of gate electrodes of fourth and fifth transistors M4 and M5. At this time, an initiation voltage (Vini) is supplied to a source electrode of the fourth transistor M4. A source electrode of a third transistor M3 connects to a drain electrode of the fourth transistor M4, and a first node (node A) connects to a drain electrode of the third transistor M3. Here, the fourth and fifth transistors M4 and M5 may have opposite polarities. Accordingly, if the first selection signal (Sel1) turns-on the fourth transistor M4, the fifth transistor M5 then turns-off. In contrast, if the fourth transistor M4 is turned-off, then the fifth transistor M5 is turned-on. That is, the signal to M4 is inverted in M5.

When the first selection signal (Sel1) turns-on the fifth transistor M5, a power voltage (Vdd) is applied to a source electrode of the fifth transistor M5. The first node (node A) connects to a drain electrode of the fifth transistor M5. At this time, the power voltage (Vdd) applied to the fifth transistor M5 is applied to the first node (node A).

The third transistor M3 generates a threshold voltage (Vthp) when the fourth transistor M4 turns-on. A voltage (Vini−Vthp) is applied to the first node (node A).

If the first selection signal (Sel1) turns-on the fifth transistor M5, then the power voltage (Vdd) is applied to the first node (node A).

If a selection signal (Sel2) is applied to a first transistor M1, then a data voltage (Vdata) is applied to a source electrode of. the first transistor M1. A drain electrode of the first transistor M1 connects to a second node (node B). Also, a condenser Cs is connected between the first node (node A) and the second node (node B) to maintain a voltage between the first node (node A) and the second node (node B) for a predetermined time.

A second transistor M2 functions as a driving switch, and M2 has a gate electrode connected to the second node (node B), a source electrode for applying the power voltage (Vdd) thereto, and a drain electrode connected to an organic light-emitting diode (OLED).

In the circuit, the first to fourth transistors M1 to M4 are PMOS transistors, and the fifth transistor is an NMOS transistor. Also, the fourth and fifth transistors M4 and M5 are complementarily operated by the first selection signal (Sel1) as described above.

Figure 5:
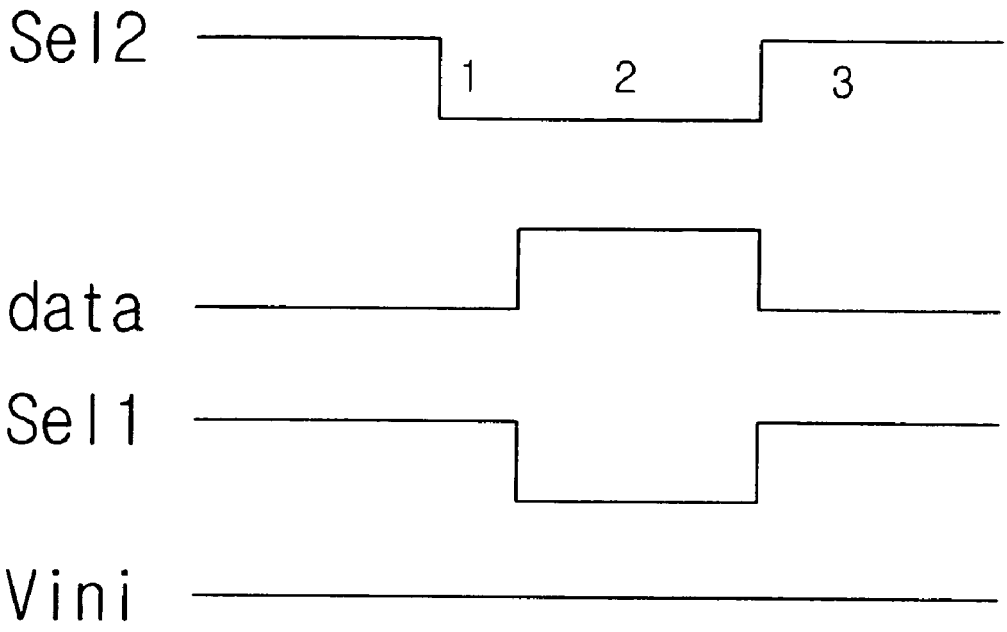
FIG. 5 shows an operation timing diagram illustrating the inventive organic light-emitting device of FIG. 4.

FIG. 5 shows the operation of the organic light-emitting device is described.

As shown in FIG. 5, a pixel operates according to three timing periods. During the first period (reset period), the second selection signal (Sel2) having a low voltage level is applied, and the data voltage (Vdata) having a low reset voltage level is applied. Here, the low reset voltage level can be about 0V or a negative voltage. During the second period, the second selection signal (Sel2) having the low voltage level and the data voltage (Vdata) having a high voltage level are applied, and the first selection signal (Sel1) having the low voltage level is applied. During the third period, the first selection signal (Sel1) and the second selection signal (Sel2) are applied at the high voltage level, and the data voltage (Vdata) is applied at the low reset voltage level. For example, the power voltage (Vdd) is 11V, and the initiation voltage (Vini) is 7V. Also, the selection signals (Sel1 and Sel2) can be at a voltage level of −5V to 15V. However, the invention is not restricted to these voltages, and any appropriate voltages can be used. At this time, the data voltage (Vdata) having the high voltage level is varied depending on the intended grayscale.

In this circuit, if the first transistor M1 is turned on by the second selection signal (Sel2) having the low voltage level during the first period, the data voltage having the low reset voltage level is applied to the second node (node B), whereby the second node (node B) is initialized.

Also, the first transistor M1 is continuously turned-on by the second selection signal (Sel2) having the low voltage level during the second period, and the data voltage (Vdata) having a high voltage level is applied to the second node (node B). On the other hand, if the fourth transistor M4 is turned-on by the first selection signal (Sel1) having the low voltage level, the initiation voltage (Vini) is applied to the fourth transistor M4 to apply a voltage difference (Vini−Vthp) between the initiation voltage (Vini) and the threshold voltage (Vthp), which is generated from the third transistor M3, to the first node (node A).

In this inventive circuit, an electrostatic capacitance Q during the second period is calculated as follows.

$$Q=Cs(\text{Vini}-\text{Vthp}-\text{Vdata}) \qquad \text{Equation 1}$$

If the fifth transistor M5 is turned-on by the first selection signal (Sel1) having the high voltage level during the third period, then the power voltage (Vdd) is applied to the first node (node A).

Here, an electrostatic capacitance Q' of the third period is calculated as follows.

$$Q'=Cs(\text{a varied voltage of the first node (node } A\text{)}-\text{a varied voltage of the second node (node } B\text{)}) \qquad \text{Equation 2}$$

Under these conditions, the varied voltage of the first node (node A) is the power voltage (Vdd).

Also, the electrostatic capacitance Q of the second period and the electrostatic capacitance Q' of the third period should be conserved, and they should therefore have the same value.

Accordingly, the electrostatic capacitance Q is equal to the electrostatic capacitance Q', and the varied voltage of the second node (node B) is calculated as follows by substituting and arranging the Equations 1 and 2.

$$\text{Varied voltage of the second node}=\text{Vdd}+\text{Vdata}-\text{Vini}+\text{Vthp} \qquad \text{Equation 3}$$

Therefore, during the third period, a driving current (I) flows through the second transistor M2 to drive the organic light-emitting diode (OLED). At this time, during the third period, a voltage (Vgs) between the gate electrode and the source electrode of the second transistor M2 is the voltage of (Vdata−Vini+Vthp).

Accordingly, the driving current (I) flowing through the second transistor M2 has the following relation equation.

$$I=K(\text{Vdata}-\text{Vini})^2 \quad \text{Equation 4}$$

where,

K: constant

Vdata: data voltage having the high voltage level

Vini: initiation voltage.

Equation 4 shows that the driving current (I) flowing the second transistor M2 is depends only on the data voltage (Vdata) and the initiation voltage (Vini), and the driving current (I) has no relation with the power voltage (Vdd) and the threshold voltage (Vthp).

Accordingly, in the driving circuit of the first embodiment of the invention, even though a threshold voltage of a driving transistor (for example, the second transistor) differs at each pixel due to the polysilicon substrate having the irregular characteristic caused by an excimer laser, the driving currents flowing through driving transistors do not depend on the threshold voltages of the driving transistors by offsetting the threshold voltages of the driving transistors with threshold voltage of the third transistors. Therefore, the driving current (I) constantly flows at each pixel irrespective of the threshold voltages of the driving transistors. As a result, the desired grayscale can be obtained.

In contrast, the related art organic light-emitting device having a large-area panel generates a drop of the power voltage at a lower side, which is a distance away from an upper side to which the power voltage is applied, thereby causing the power voltage to influence the driving current. As a result, the related art device fails to obtain the desired grayscale.

However, if the driving circuit is constructed as in the first embodiment of the invention, then the driving current (I) has no relation with the power voltage (Vdd). Therefore, a constant driving current flows irrespective of the upper side or the lower side of the large-area panel. As a result, the invention easily obtains the desired grayscale.

Figure 6:
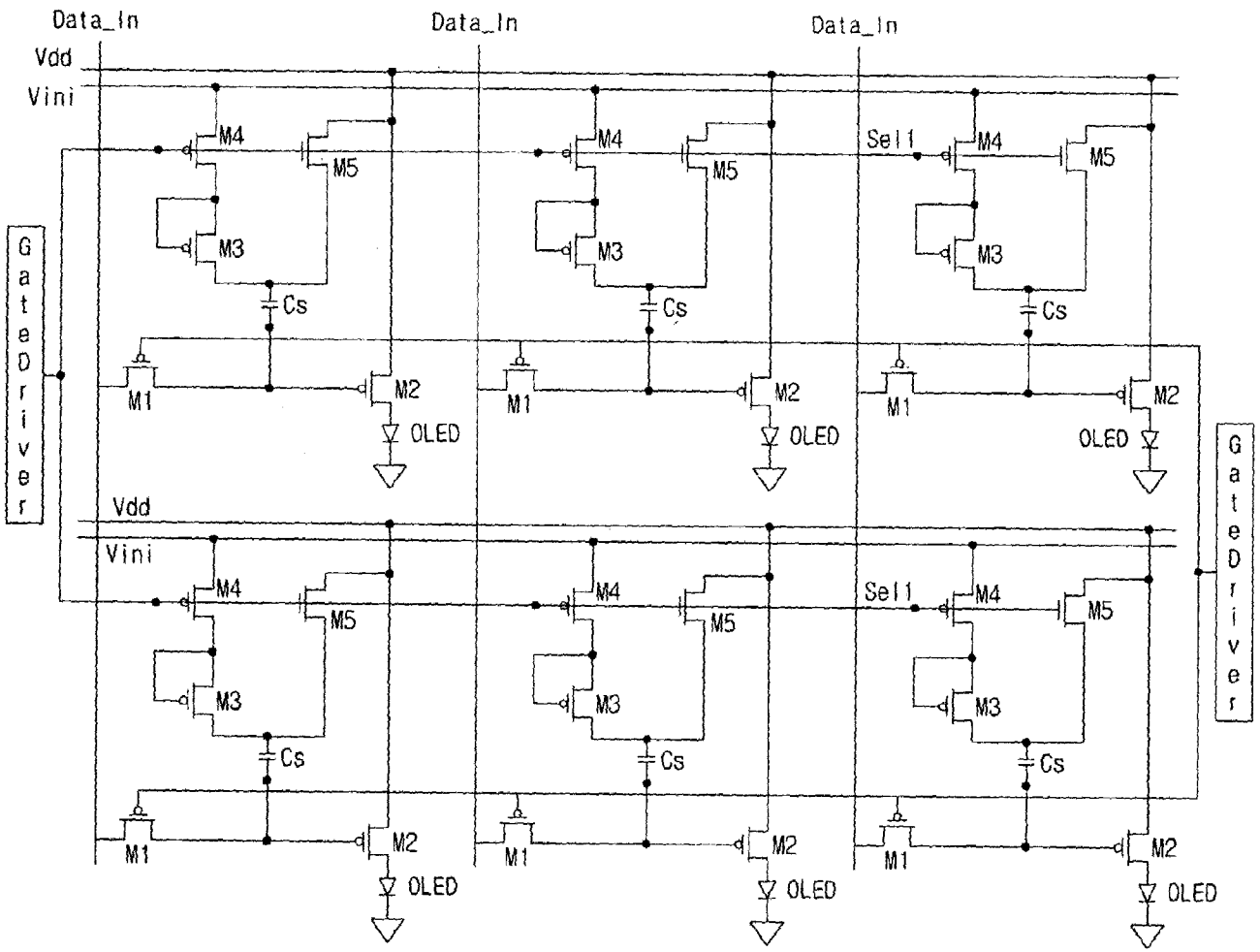
FIG. 6 illustrates an entire pixel array of an organic light-emitting device according to a first embodiment of the invention.

FIG. 6 shows a view illustrating an entire pixel array (or a portion thereof) of the organic light-emitting device according to the first embodiment of the invention. FIG. 6 illustrates the organic light-emitting device having a matrix of the pixels of FIG. 4 connected and arrayed. FIG. 6 illustrates an organic light-emitting device having 2×3 pixels, but can also arrange more pixels as the panel area is increased. That is, the invention is not restricted to the number of pixels.

FIG. 6 shows that the first and second selection signals are applied from first and second gate drivers, and a data voltage (Vdata_In) is applied from a data driver (not shown). A power voltage (Vdd) can be applied from a separate power-supplying unit (not shown).

Figure 7:
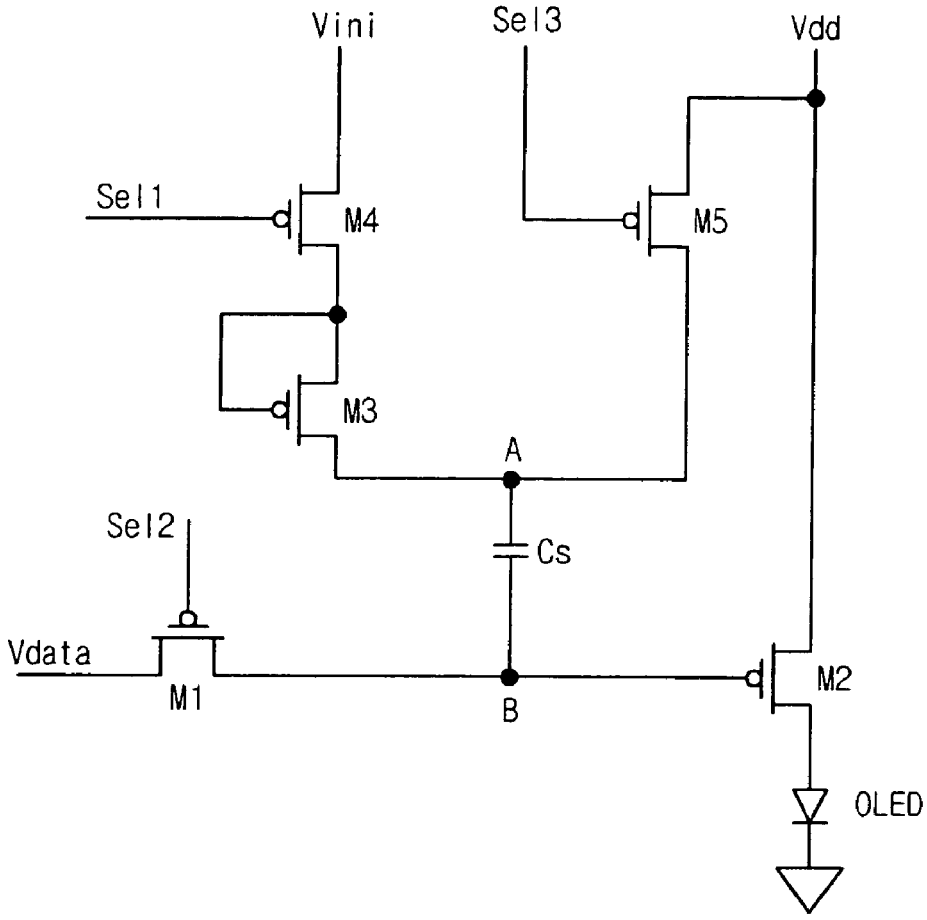
FIG. 7 illustrates a pixel of an organic light-emitting device according to a second embodiment of the invention.

FIG. 7 illustrates a pixel of an organic light-emitting device according to a second embodiment of the invention, and typically illustrates one of N×M pixels.

The organic light-emitting device of the second embodiment of the invention shown in FIG. 7 has similarities with the organic light-emitting device according to the first embodiment of the invention shown in FIG. 4. However, the organic light-emitting device according to the first embodiment of the invention uses a CMOS transistor having opposite polarities as fourth and fifth transistors M4 and M5 to concurrently apply a first selection signal (Sel1) to the fourth and fifth transistors M4 and M5. That is, the fourth transistor M4 is composed of a PMOS transistor, and the fifth transistor M5 is composed of an NMOS transistor. Therefore, if the fourth transistor M4 is turned-on by the first selection signal (Sel1), then the fifth transistor M5 is turned-off.

In comparison, the organic light-emitting device according to the second embodiment of the invention uses the PMOS transistors as the fourth and fifth transistors M4 and M5 to apply the first selection. signal (Sel1) to the fourth transistor M4 and separately apply a third selection signal (Sel3) to the fifth transistor M5.

Additionally, a connection structure of the first to third transistors M1 to M3 according to the second embodiment of the invention is similar the first embodiment of the invention.

Accordingly, the organic light-emitting device according to the second embodiment of the invention uses PMOS transistors for all of the first to fifth transistors M1 to M5. This construction thereby reduces the number of masks used during processing, and greatly reducing the process cost through implementing a simplified process.

Since a driving operation of the second embodiment of the invention can be easily understood from the first embodiment of the invention, an additional description is omitted.

Figure 8:
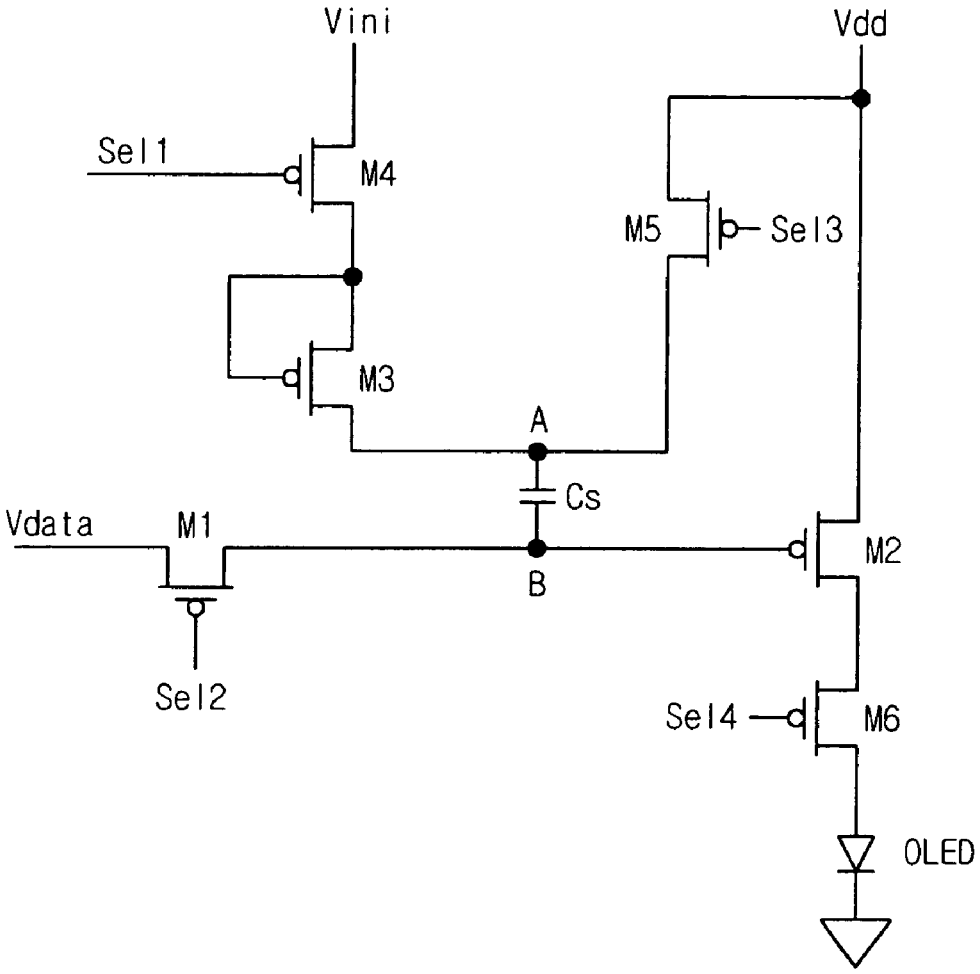
FIG. 8 illustrates a pixel of an organic light-emitting device according to a third embodiment of the invention.

FIG. 8 shows a view illustrating a pixel of an organic light-emitting device according to a third embodiment of the invention, and typically illustrates one of a display having N×M pixels.

The organic light-emitting device according to the second embodiment of the invention shown in FIG. 7 allows an organic light-emitting diode (OLED) to pass a high current during a first period (that is, reset period) for which a low reset voltage is applied by the second selection signal (Sel2). Accordingly, the organic light-emitting device has difficulty expressing a dark grayscale, and the device also has a reduced contrast ratio.

In the organic light-emitting device according to the third embodiment of the invention shown in FIG. 8, a sixth transistor M6 is connected between a second transistor M2 and the organic light-emitting diode (OLED), and the sixth transistor M6 is controlled by a separate fourth selection signal (Sel4). That is, a data voltage having a low reset voltage level is applied to a second node (node B) through a first transistor M1 during the reset period to initialize the second node (node B). As a result, the high current can spontaneously flow to the organic light-emitting diode (OLED). In order to prevent the high current from flowing to the organic light-emitting diode (OLED), the sixth transistor M6 is connected between the second transistor M2 and the organic light-emitting diode (OLED). The sixth transistor M6 can therefore be controlled by a fourth selection signal (Sel4). That is, when the data voltage (Vdata) having the low reset voltage level is applied under the control of the second selection signal (Sel2), the sixth transistor M6 is turned-off by the fourth selection signal having the high voltage level, thereby cutting-off the flow of the high current to the organic light-emitting diode (OLED).

The transistors M1 to M6 of the organic light-emitting device according to the third embodiment of the invention are all PMOS transistors.

Figure 9:
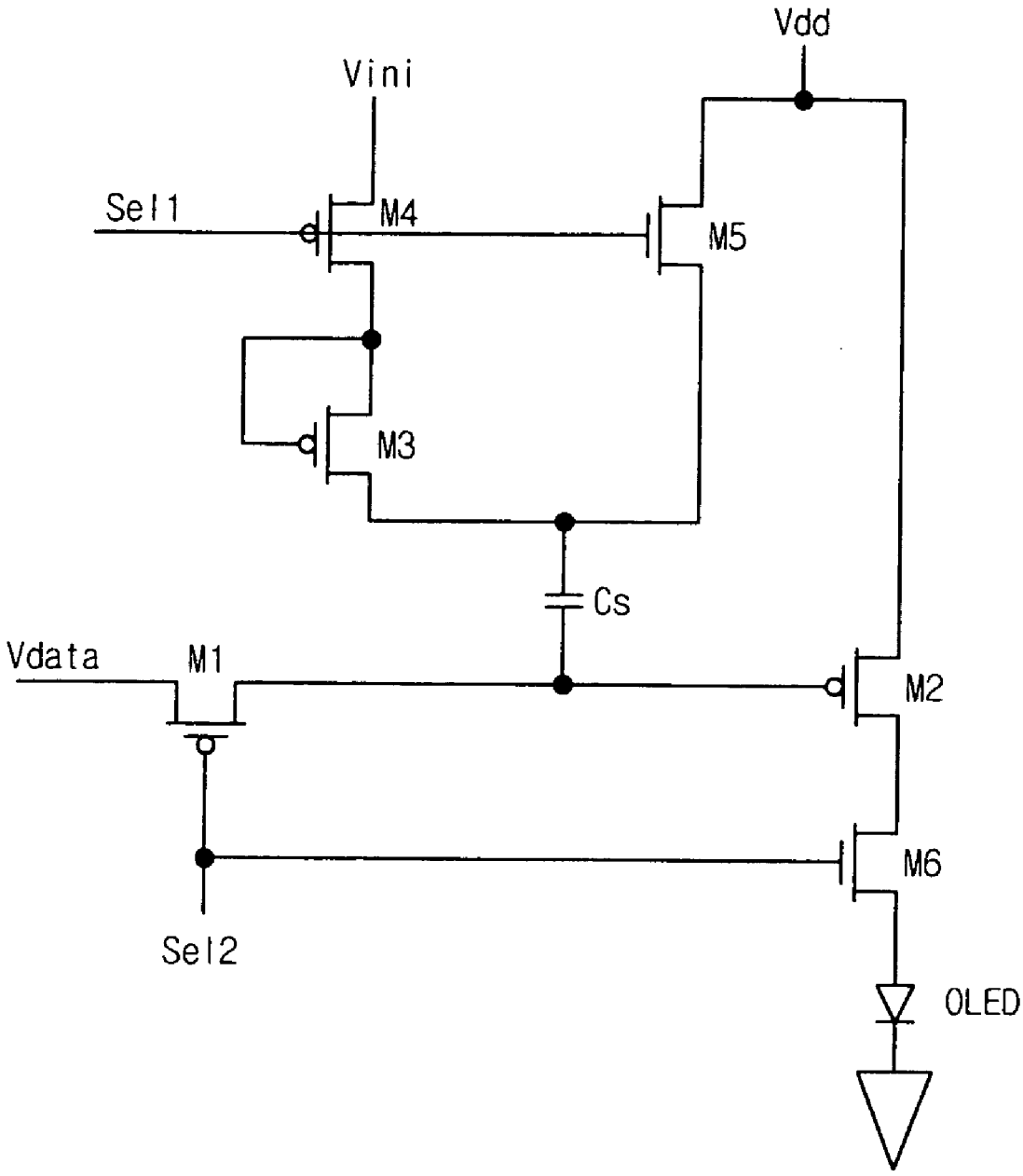
FIG. 9 illustrates a pixel of an organic light-emitting device according to a fourth embodiment of the invention.

FIG. 9 shows a view illustrating a pixel of an organic light-emitting device according to a fourth embodiment of the invention, and typically illustrates one pixel of an array of N×M pixels.

The organic light-emitting device according to the fourth embodiment of the present represents a variation of the organic light-emitting device according to the third embodiment of the invention. That is, the organic light-emitting device according to the fourth embodiment of the invention has a sixth transistor M6 controlled by a second selection signal (Sel2) and is composed of an NMOS transistor instead of a PMOS transistor. The first transistor M1 and the sixth transistor M6 can be concurrently controlled by the second selection signal (Sel2).

Accordingly, for initialization, a data voltage (Vdata) having a low reset voltage level is applied through the first transistor M1 by the second selection signal (Sel2) having the low voltage level. At the same time, the second selection signal (Sel2) having the low voltage level turns-off the sixth transistor M6 to cut-off the flow of the high current to the organic light-emitting diode (OLED).

In the organic light-emitting device, the first and sixth transistors M1 and M6 are concurrently formed through a CMOS process such that the first and sixth transistors M1 and M6 are concurrently controlled by the second selection signal (Sel2), thereby reducing the number of selection lines for applying a selection signal thereto. As a result, the cost can be reduced and the aperture ratio can be improved.

Figure 10:
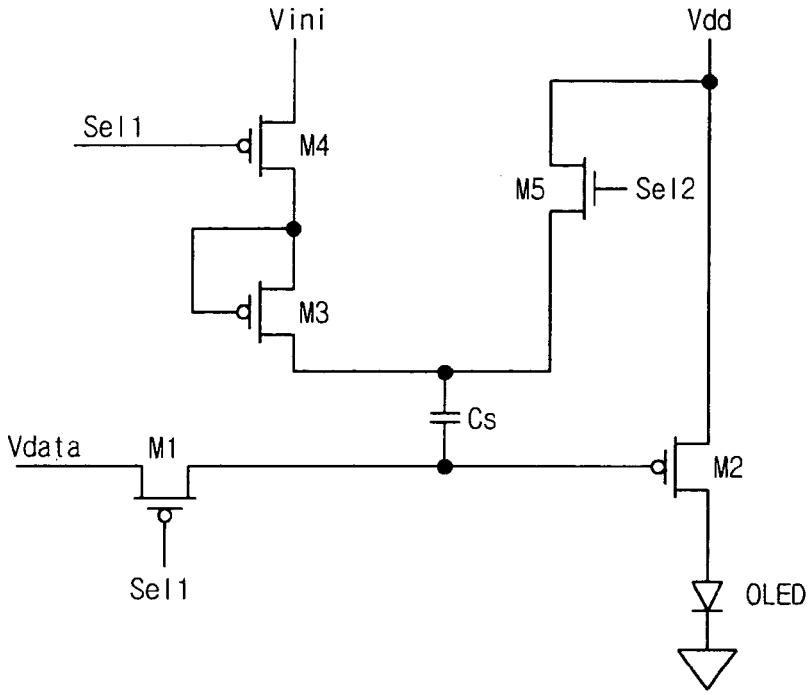
FIG. 10 illustrates a pixel of an organic light-emitting device according to a fifth embodiment of the invention.

FIG. 10 shows a view illustrating a pixel of an organic light-emitting device according to a fifth embodiment of the invention, and typically illustrates one of the N×M pixels of an array. The organic light-emitting device according to the fifth embodiment of the invention represents a variation of the light-emitting device according to the second embodiment of the invention.

As shown in FIG. 10, the same first selection signal (Sel1) controls a first transistor M1 and a fourth transistor M4. That is, FIG. 10 shows the case where the first and fourth transistors M1 and M4 are composed of PMOS transistors, and the first selection signal (Sel1) having a low voltage level allows the data voltage (Vdata) to be applied through the first transistor M1. Also, at the same time, the initiation voltage (Vini) is applied through the fourth transistor M4. On the other hand, the first and fourth transistors M1 and M4 can be concurrently turned-off by the first selection signal (Sel1) having the high voltage level.

Further, the organic light-emitting device has a fifth transistor M5 that is composed of an NMOS transistor. At this time, the first selection signal (Sel1) and the second selection signal (Sel2) should have the same voltage levels. That is, when the first selection signal (Sel1) has a high voltage level, the second selection signal (Sel2) should have the high voltage level. By doing so, the fourth transistor M4 and the fifth transistor M5 can be complementarily turned-on/off.

In FIG. 10, the organic light-emitting device has all of the first to fourth transistors M1 to M4 being composed of PMOS transistors. Further, the fifth transistor M5 can be composed of NMOS transistors.

Also in FIG. 10, the first and fourth transistors M1 and M4 are controlled by one first selection signal (Sel1), thereby reducing the number of the selection lines. As a result, the production cost can be reduced and the aperture ratio can be improved.

Figure 11:
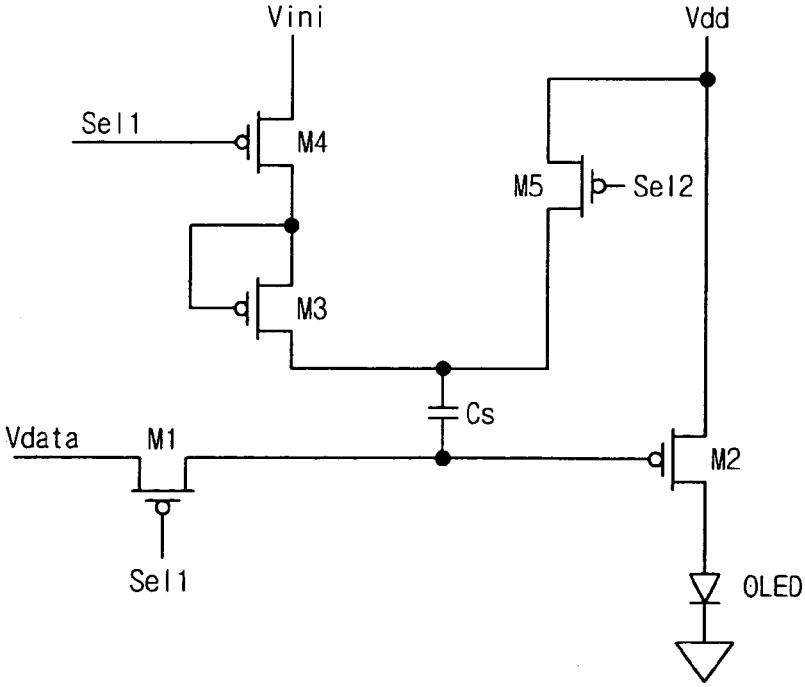
FIG. 11 illustrates a pixel of an organic light-emitting device according to a sixth embodiment of the invention.

FIG. 11 shows a view illustrating a pixel of an organic light-emitting device according to a sixth embodiment of the invention, and typically illustrates one of the N×M pixels of an array.

The organic light-emitting device according to the sixth embodiment of the invention represents a variation of the organic light-emitting device according to the fifth embodiment of the invention. That is, in the organic light-emitting device, transistors M1 to M4 are the same as those of the fifth embodiment of the invention, but a fifth transistor M5 is a PMOS transistor. Accordingly, transistors M1 to M5 of the organic light-emitting device according to the sixth embodiment of the invention are all PMOS transistors.

Here, the first selection signal (Sel1) for controlling the fourth transistor M4 and the second selection signal (Sel2) for controlling the fifth transistor M5 should be applied at different voltage levels. That is,. when the first selection signal (Sel1) has a low voltage level, the second selection signal (Sel2) should have a high voltage level. On the other hand, when the first selection signal (Sel1) has the high voltage level, the second selection signal (Sel2) should have the low voltage level. Accordingly, the fourth and fifth transistors M4 and M5 are complementarily turned-on/off by the first and second selection signals (Sel1) and (Sel2) having different voltage levels.

As described above, in the organic light-emitting device according to the sixth embodiment of the invention, transistors M1 to M5 are all only PMOS transistors, thereby reducing the process cost.

Figure 12:
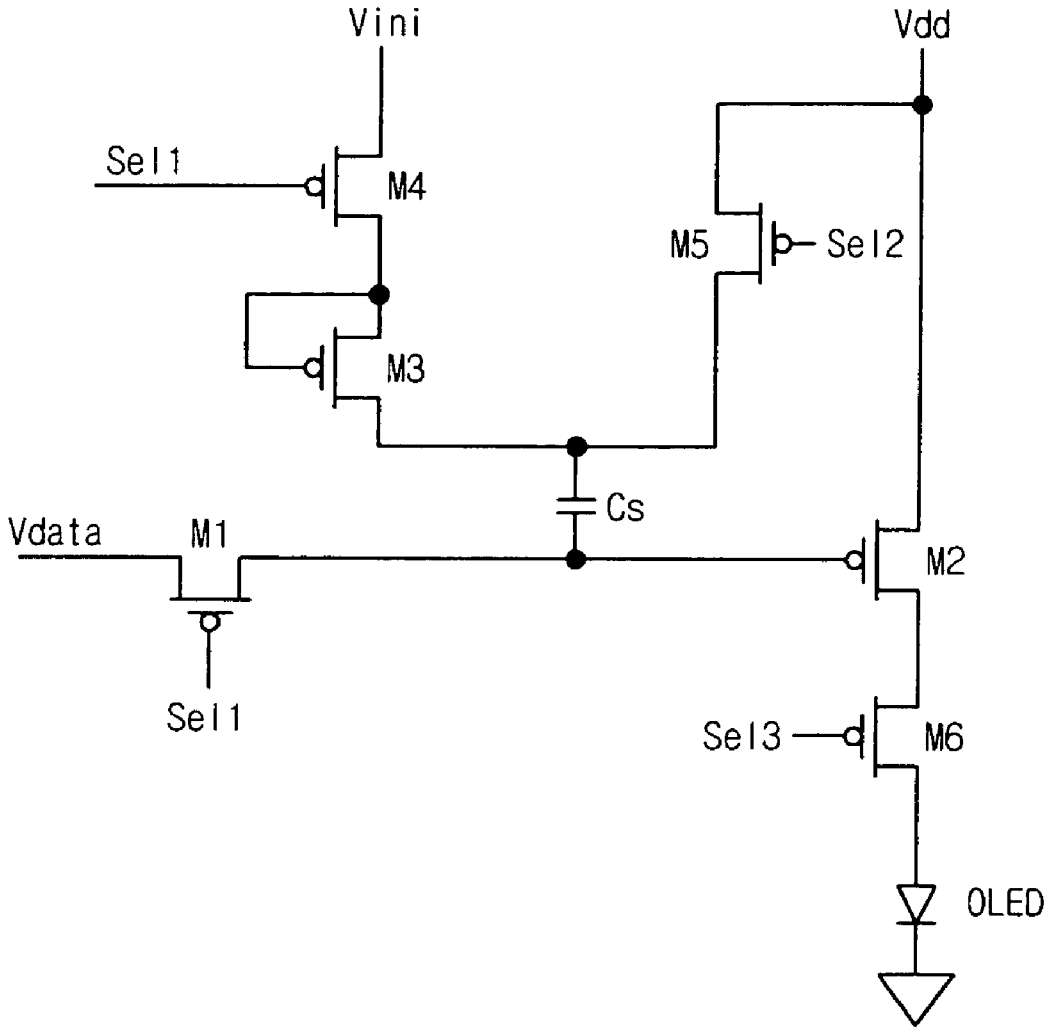
FIG. 12 illustrates a pixel of an organic light-emitting device according to a seventh embodiment of the invention.

FIG. 12 shows a view illustrating a pixel of an organic light-emitting device according to a seventh embodiment of the invention, and typically illustrates one of the N×M pixels of an array.

The organic light-emitting device according to the seventh embodiment of the invention represents a variation of both the organic light-emitting devices according to the third embodiment and the sixth embodiment. That is, the organic light-emitting device according to the seventh embodiment of the invention has a sixth transistor M6 that is a PMOS transistor, which connects between a second transistor M2 and an organic light-emitting diode (OLED) to be turned-on/off by a third selection signal (Sel3), thereby cutting-off the flow of a high current to the organic light-emitting diode (OLED) during a reset period.

If the first transistor M1 is turned-on during the reset period under the control of the first selection signal (Sel1) having the low voltage level, a data voltage (Vdata) having a low reset voltage level is applied through the first transistor M1 to initializes. At the same time, the sixth transistor M6 is turned-off under the control of a third selection signal (Sel3) having a high voltage level such that the high current dose not flow to the organic light-emitting diode (OLED). Accordingly, a dark grayscale is expressed, thereby improving the contrast ratio.

Further, in the inventive organic light-emitting device, the same first selection signal (Sel1) is applied to the first and fourth transistors M1 and M4. The first and fourth transistors M1 and M4 are accordingly concurrently turned-on/off by the first selection signal (Sel1). As such, one first selection signal (Sel1) concurrently controls the two transistors M1 and M4, thereby reducing the number of selection lines and accordingly reducing the process cost.

Further, the first to sixth transistors M1 to M6 shown in FIG. 12 are all PMOS transistors, thereby further reducing the process cost.

Figure 13:
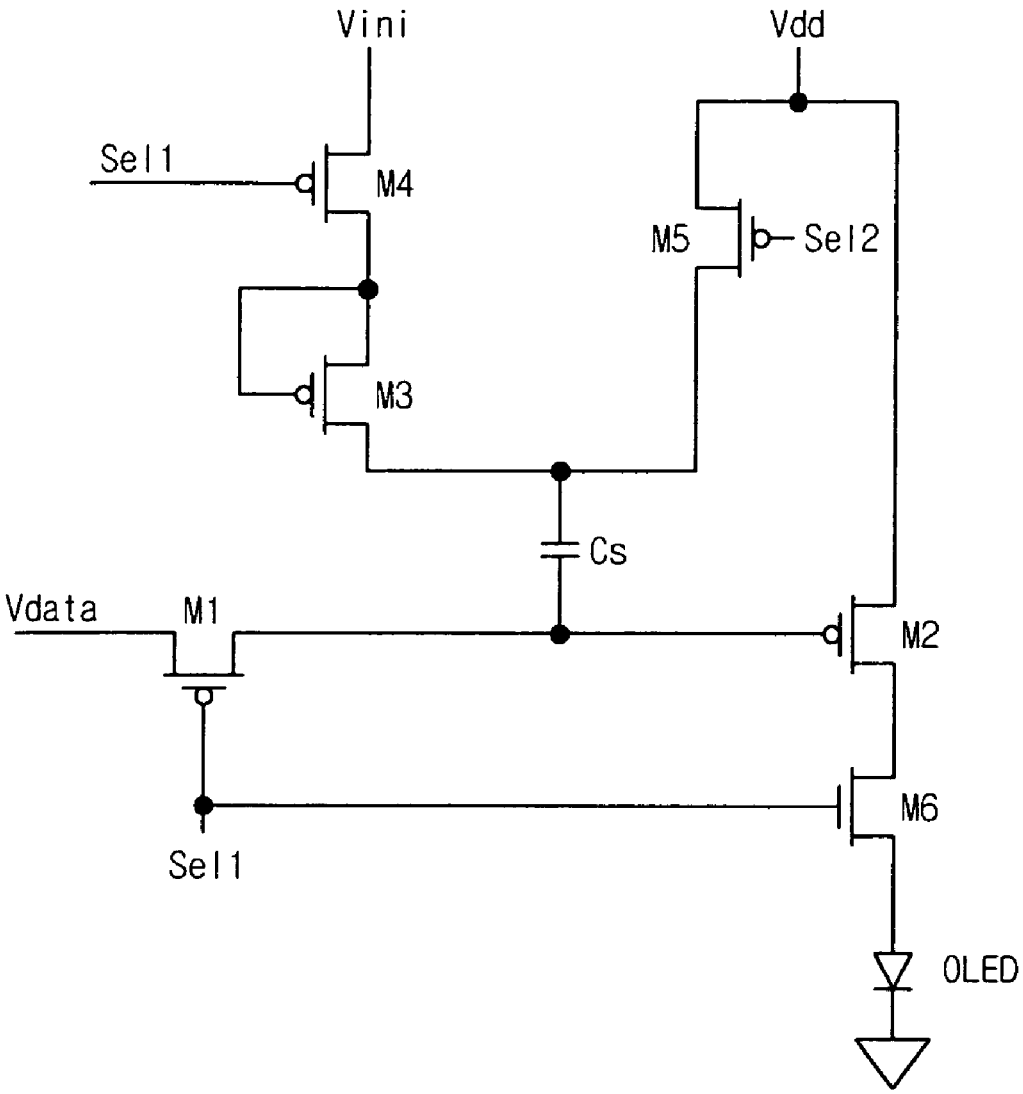
FIG. 13 illustrates a pixel of an organic light-emitting device according to an eighth embodiment of the invention.

FIG. 13 shows a view illustrating a pixel of an organic light-emitting device according to an eighth embodiment of the invention.

The organic light-emitting device according to the eighth embodiment of the invention represents a variation of the organic light-emitting device according to the seventh embodiment of the invention. That is, the organic light-emitting device according to the eighth embodiment of the invention has the same transistors M1 to M5 as those of the seventh embodiment of the invention. However, a sixth transistor M6 of the eighth embodiment is a NMOS transistor instead of the PMOS transistor of the seventh embodiment. Accordingly, the transistors M1 to M5 of the organic light-emitting device according to. the eighth embodiment of the invention are all PMOS transistors.

In particular, the organic light-emitting device according to the seventh embodiment of the invention has the sixth transistor M6 being a PMOS transistor, whereas the organic light-emitting device according to the eighth embodiment of the invention has a sixth transistor M6 being an NMOS transistor. Accordingly, the same first selection signal (Sel1) is concurrently applied to turn-on/off the first, fourth and sixth transistors M1, M4 and M6. For example, if the first selection signal (Sel1) has the low voltage level, then the first and fourth transistors M1 and M4 are turned-on and the sixth transistor M6 is turned-off. On the other hand, if the first selection signal (Sel1) has a high voltage level, then the first and fourth transistors M1 and M4 are turned-off and the sixth transistor M6 is turned-on.

In the eighth embodiment, one first selection signal (Sel1) complementarily concurrently controls the first and sixth transistors M1 and M6 and also controls the fourth transistor M4, thereby reducing the number of selection lines. As a result, a process cost can be reduced and the aperture ratio can be improved.

Also, since the organic light-emitting devices according to the first to eighth embodiments of the invention use five or six transistors at each pixel, they have a drawback in that the aperture ratio reduces due to their wide occupation area, i.e., footprint, in comparison with the related art organic light-emitting device using two transistors at each of pixel.

Figure 14:
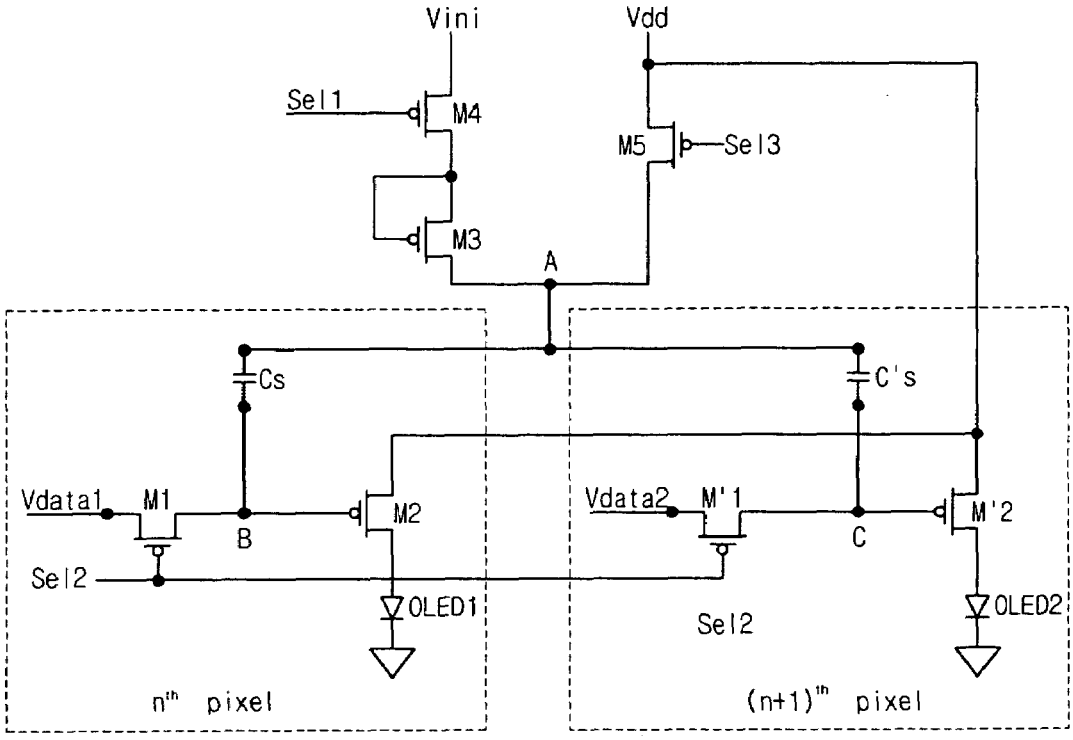
FIG. 14 illustrates a pixel of an organic light-emitting device according to a ninth embodiment of the invention.

FIG. 14 shows a view illustrating a pixel of an organic light-emitting device according to a ninth embodiment of the invention, and typically illustrates one of the N×M pixels of an array.

Referring to FIG. 14, a first selection signal (Sel1) is applied to a gate electrode of a fourth transistor M4, and a third selection signal (Sel3) is applied to a gate electrode of a fifth transistor M5. At this time, an initiation voltage (Vini) is supplied to a source electrode of the fourth transistor M4. A source electrode of a third transistor M3 connects to a drain electrode of the fourth transistor M4, and a first node (node A) is connects to a drain electrode of the third transistor M3. Here, the fourth and fifth transistors M4 and M5 are complementarily turned-on/off. That is, if the fourth transistor M4 is turned-on by the first selection signal (Sel1), then the fifth transistor M5 is turned-off by the third selection signal (Sel3). In this case, the first selection signal (Sel1) has a low voltage level, and the third selection signal (Sel3) has a high voltage level. On the other hand, if the fourth transistor M4 is turned-off by the first selection signal (Sel1), then the fifth transistor MS is turned-on by the third selection signal (Sel3). In this case, the first selection signal (Sel1) has the high voltage level, and the third selection signal (Sel3) has the low voltage level.

When the third selection signal (Sel3) is applied to a gate electrode of a fifth transistor MS, and the fifth transistor MS is turned on by the third selection signal (Sel3), the power voltage (Vdd) is applied to a source electrode of the fifth transistor M5. Also, the first node (node A) connects to a drain electrode of the fifth transistor M5. Accordingly, when the fifth transistor M5 is turned-on by the third selection signal (Sel3), the power voltage (Vdd) is applied to the first node (node A) through the fifth transistor M5.

The third transistor M3 generates a threshold voltage (Vthp) when the fourth transistor M4 is turned-on. A voltage (Vini−Vthp) is applied to the first node (node A). At this time, a first pixel includes a first transistor M1 for applying a first data voltage (Vdata1) depending on a second selection signal (Sel2), and a second transistor M2 for allows the flow of a first driving current depending on the first data voltage (Vdata). Also, a second node (node B) is provided between a drain electrode of the first transistor M1 and a gate electrode of the second transistor M2, a condenser Cs connects between the first node (node A) and the second node (node B), and a first organic light-emitting diode (OLED1) connects to a drain electrode of the second transistor M2.

Similarly, a second pixel includes another first transistor M'1 for applying a second data voltage (Vdata2) depending on the second selection signal (Sel2), and another second transistor M'2 for allows the flow of a second driving current depending on the second data voltage (Vdata2). Also, a third node (node C) is provided between a drain electrode of the another first transistor M'1 and a gate electrode of the other second transistor M'2, a condenser C's connects between the first node (node A) and the third node (node C), and a second organic light-emitting diode (OLED2) connects to a drain electrode of the another second transistor M'2.

In the ninth embodiment of the invention, the third to fifth transistors M3 to M5 are shared by two or more pixels. Accordingly, in comparison with the organic light-emitting device having all of the third to fifth transistors M3 to M5 at each pixel, the inventive organic light-emitting device can greatly reduce the number of the transistors to save production cost and improve the aperture ratio.

For example, if five transistors are basically used at one pixel, then two pixels need ten transistors in total. In this case, two pixels require only seven transistors for the ninth embodiment of the invention. Therefore, three transistors can be eliminated. If the above technology is applied to all pixels, then the transistors are greatly reduced in number to thereby greatly reduce costs. Further, the reduced number of transistors at each pixel improves the aperture ratio.

All transistors M1 to M5, M'1 and M'2 described above are PMOS transistors.

Figure 15:
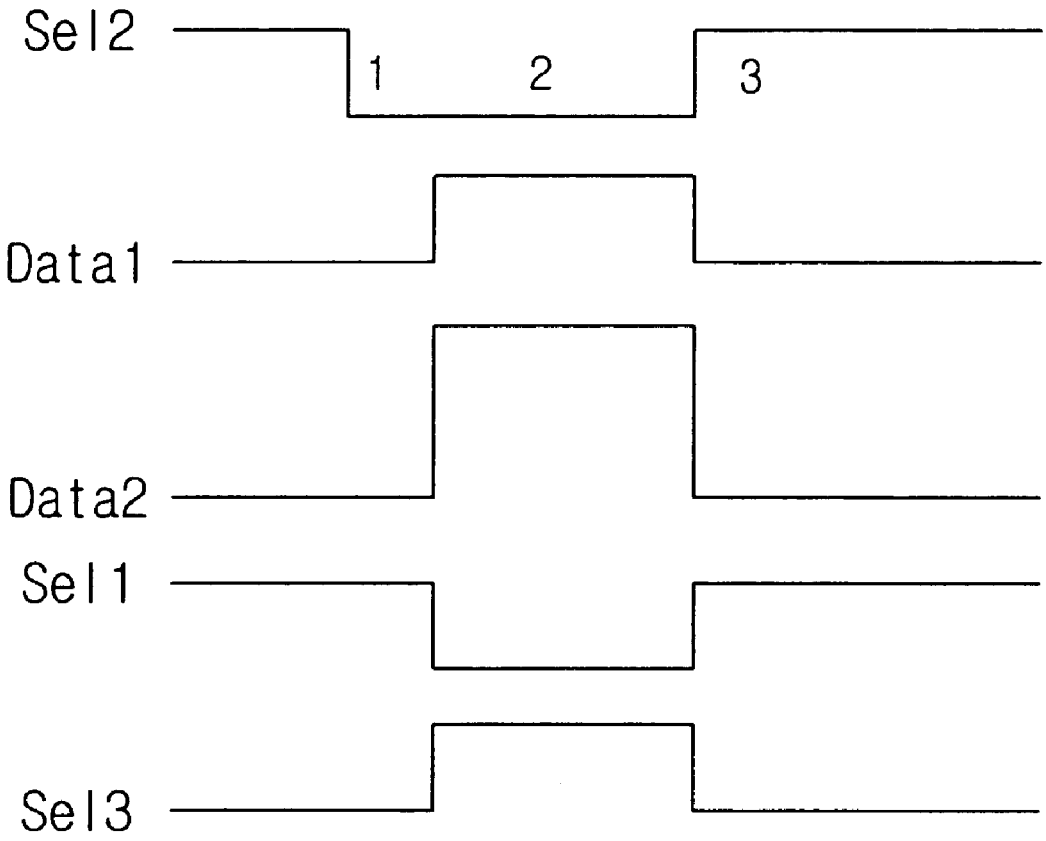
FIG. 15 shows a view illustrating an operation timing diagram of the inventive organic light-emitting device of FIG. 14.

FIG. 15 illustrates a timing diagram showing the operation of the above light-emitting device. This operation is virtually similar to that of the first embodiment of the invention.

Referring to FIG. 15, a pixel operates according to three time periods. That is, if the first and another first transistors M1 and M'1 are turned-on by the second selection signal (Sel2) having the low voltage level during the first period, then the first and second data voltages (Vdata1) and (Vdata2) having the low reset voltage levels are respectively applied to the second node (node B) and the third node (node C) to initialize the second node (node B) and the third node (node C).

Next, if the first transistor M1 is turned-on by the second selection signal (Sel2) having the low voltage level during the second period, then the first data voltage (Vdata1) having the high voltage level is applied to the second node (node B) In the meantime, if the other first transistor M'1 is turned-on by the second selection signal (Sel2) having the low voltage level, then the second data voltage (Vdata2) having the high voltage level is applied to the third node (node C). Further, if the fourth transistor M4 is turned-on by the first selection signal (Sel1) having the low voltage level, then the initiation voltage (Vini) is applied to the fourth transistor M4, to thereby apply a voltage difference (Vini−Vthp) between the initiation voltage (Vini) and the threshold voltage (Vthp), which is generated at the third transistor M3, to the first node (node A). At this time, the fifth transistor M5 is turned-off by the third selection signal (Sel3) having the high voltage level.

If the fifth transistor M5 is turned-on by the third selection signal (Sel3) having the low voltage level during the third period, then the power voltage (Vdd) is applied to the first node (node A).

At this time, according to the Equations 1 and 2 as described above, the second node (node B) has a voltage of (Vdd+Vdata1−Vini+Vthp), and the third node (node C) has a voltage of (Vdd+Vdata2−Vini+Vthp). Accordingly, the voltage (Vgs1) between the gate and source electrodes of the second transistor M2 becomes a voltage of (Vdata1−Vini+Vthp), and the voltage between the gate and source electrodes of the other second transistor M'2 becomes a voltage of (Vdata2−Vini+Vthp).

Accordingly, the voltage (Vgs1) between the gate and source electrodes of the second transistor M2 causes a first driving current ($I1=K(Vdata1-Vini)^2$) to flow to the second transistor M2. In addition, the voltage (Vgs2) between the gate and source electrodes of the other second transistor M'2 causes a second driving current ($I2=K(Vdata2-Vini)^2$) to flow to the other second transistor M'2.

As a result, the first organic light-emitting diode (OLED1) is driven by the first driving current (I1), and the second organic light-emitting diode (OLED2) is driven by the second driving current (I2).

The ninth embodiment of the invention exemplarily connects two pixels to the first node (node A), but more pixels can be commonly connected to the first node (node A) if necessary. As a result, the circuit can be used to drive any number of pixels to further reduce manufacture costs and enhance the aperture ratio.

Therefore, the first and the second driving current (I1) and (I2) do not depend on the power voltage (Vdd) and the threshold voltage (Vthp) at all. Accordingly, the driving current can be absolutely prevented from being varied depending on the variation of threshold voltage, which is caused by a device irregularity characteristic, to obtain the desired grayscale. In a large-area panel, the power voltage can be prevented from being dropped between the upper side and the lower side due to the resistance of the line that applies the power voltage (Vdd) thereto.

Further, connecting at least two pixels to the first node (node A) reduces the number of transistors, thereby greatly saving processing costs and improving the aperture ratio.

Figure 16:
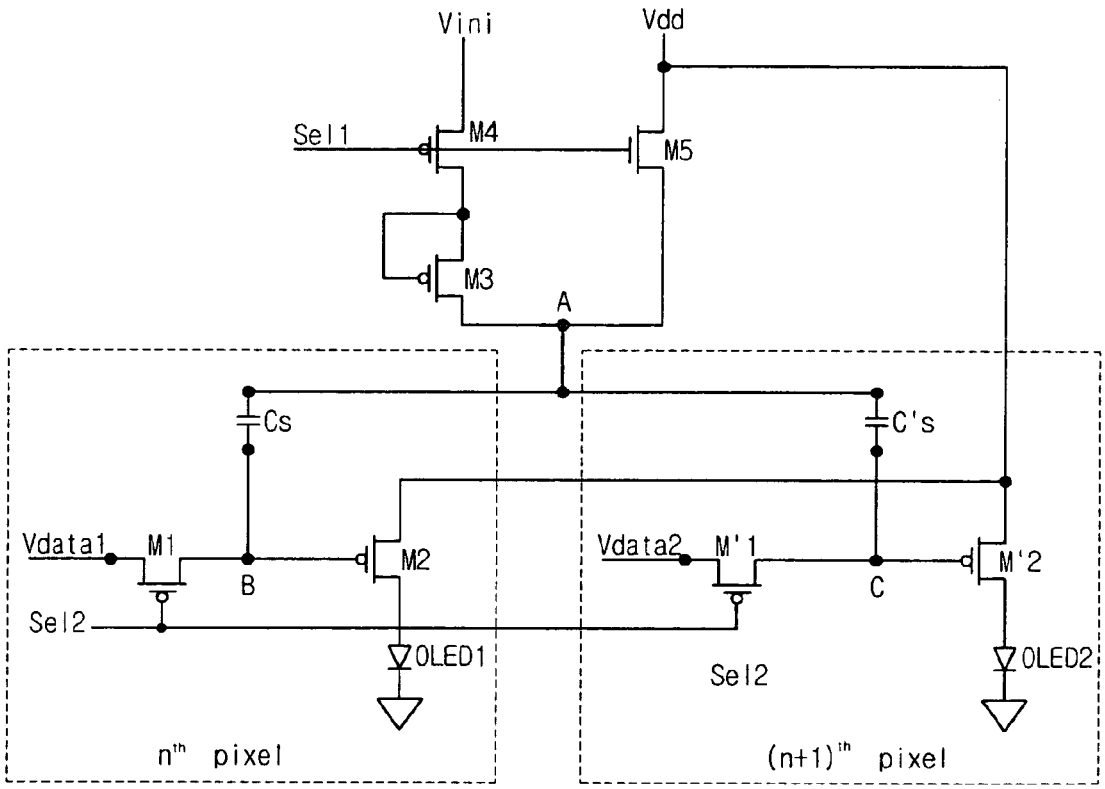
FIG. 16 illustrates a pixel of an organic light-emitting device according to a tenth embodiment of the invention.

FIG. 16 shows a view illustrating a pixel of an organic light-emitting device according to a tenth embodiment of the invention, and typically illustrates one of the N×M pixels of an array.

Unlike the ninth embodiment of the invention, the fourth and fifth transistors M4 and M5 can be also controlled by only one first selection signal (Sel1) in the tenth embodiment of the invention. At this time, it is preferable that the fourth and the fifth transistors M4 and M5 have opposite polarities. That is, when the fourth transistor M4 is a PMOS transistor, the fifth transistor M5 is an NMOS transistor. On the other hand, when the fourth transistor M4 is a NMOS transistor, the fifth transistor M5 is a PMOS transistor.

As such, one first selection signal (Sel1) functions to concurrently control the fourth and fifth transistors M4 and M5, thereby reducing the number of selection lines for more effective driving.

Figure 17:
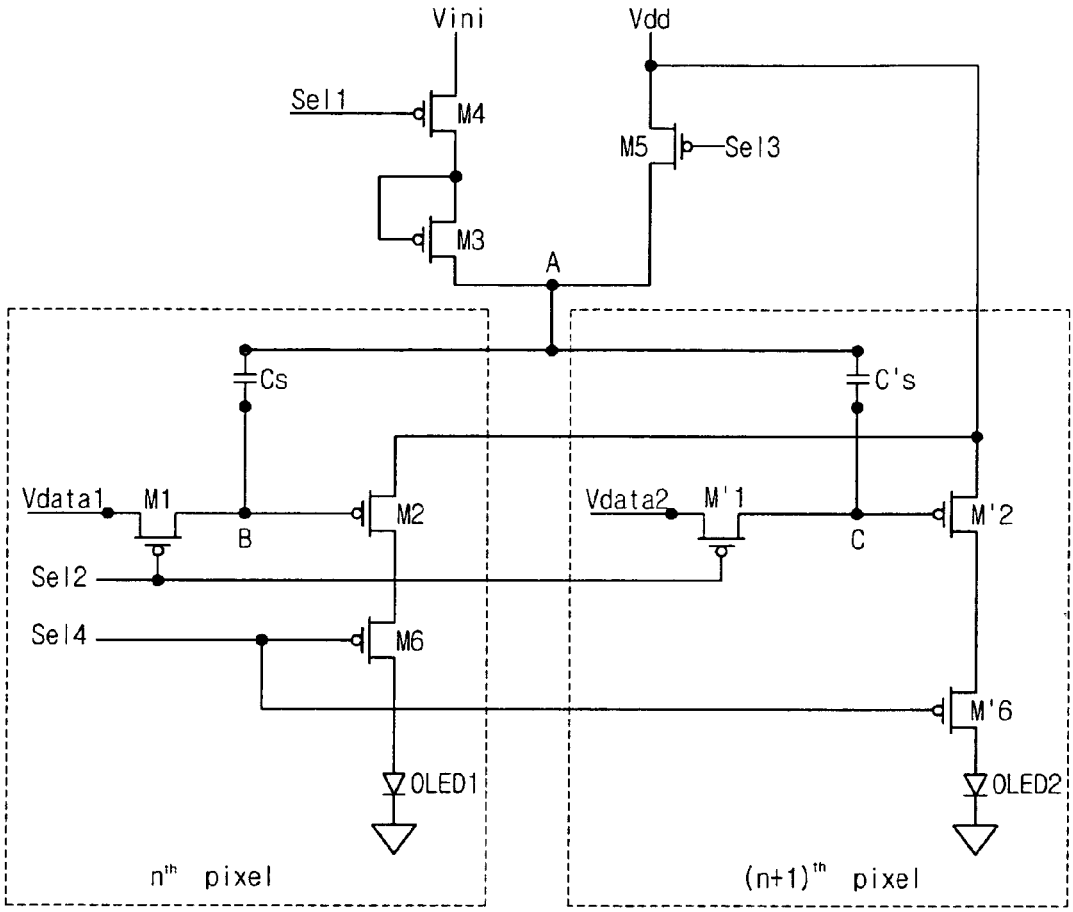
FIG. 17 illustrates a pixel of an organic light-emitting device according to an eleventh embodiment of the invention.

FIG. 17 shows a view illustrating a pixel of an organic light-emitting device according to an eleventh embodiment of the invention, and typically illustrates one of the N×M pixels of an array.

In FIG. 17, all of the transistors M1 to M6, M'1, M'2 and M'6 are PMOS transistors. The sixth transistors M6 and M'6 are used for cutting-off the flow of the high current to the organic light-emitting diodes (OLED1 and OLED2) as described in FIG. 8.

Here, the construction change of the transistors according to the first to eighth embodiments of the invention can be identically applied to the ninth to eleventh embodiments of the invention.

As described above, the invention uses five transistors to compensate the threshold voltage, thereby preventing a stripe pattern from being generated due to the device irregularity and to exclude the influence of the driving current on the power voltage, thereby preventing a drop of the power voltage depending on a device large area.

Further, the invention can connect a driving circuit to several pixels to compensate the threshold voltage and prevent a drop of the power voltage such that the number of transistors can be reduced, thereby saving the processing cost and concurrently improving the aperture ratio.

It will be apparent to those skilled in the art that various modifications and variations can be made in the invention. Thus, it is intended that the invention covers the modifications and variations of this invention provided they come within the scope of the appended claims and their equivalents.

What is claimed is:

1. An organic light-emitting device comprising:
- a first transistor for applying a data voltage;
- a second transistor for applying a driving current depending on the data voltage and an initiation voltage to an organic light-emitting diode;
- a third transistor for generating a threshold voltage;
- a fourth transistor for applying the initiation voltage, the fourth transistor being connected to the third transistor;
- a fifth transistor for applying a power voltage; and
- a condenser provided between a first node connected to the third and fifth transistors and a second node connected to the first and second transistors, for maintaining the power voltage and the threshold voltage for compensation.

2. The device according to claim 1, wherein the driving current is determined by a difference between the data voltage and the initiation voltage.

3. The device according to claim 1, wherein the threshold voltage maintained by the condenser compensates a threshold voltage of the second transistor.

4. The device according to claim 1, wherein the power voltage maintained by the condenser compensates a power voltage applied to the second transistor.

5. The device according to claim 1, wherein the first to fourth transistors are PMOS transistors, the fifth transistor is an NMOS transistor, the fourth and fifth transistors are complementarily controlled by a first selection signal, and the first transistor is controlled by a second selection signal.

6. The device according to claim 1, wherein the first to fifth transistors are PMOS transistors, and the first, fourth and fifth transistors are controlled by different selection signals.

7. The device according to claim 1, wherein the first to fourth transistors are PMOS transistors, the fifth transistor is an NMOS transistor, the first and fourth transistors are controlled by the first selection signal, the fifth transistor is controlled by the second selection signal, and the first and second selection signals are at the same voltage level.

8. The device according to claim 1, wherein the first to fifth transistors are PMOS transistors, the first and fourth transistors are controlled by the first selection signal, and the fifth transistor is controlled by the second selection signal, and the first and second selection signals are at different voltage levels.

9. An organic light-emitting device comprising:
- a first transistor for applying a data voltage;
- a second transistor for applying a driving current depending on the data voltage and an initiation voltage to an organic light-emitting diode;
- a third transistor for generating a threshold voltage;
- a fourth transistor for applying the initiation voltage, the fourth transistor being connected to the third transistor;
- a fifth transistor for applying a power voltage;

a condenser provided between a first node connected to the third and fifth transistors and a second node connected to the first and second transistors, for maintaining the power voltage and the threshold voltage for compensation; and a sixth transistor connected between the second transistor and the organic light-emitting diode, for cutting off a high current flowing to the organic light-emitting diode during a reset period for which the second node is initialized.

10. The device according to claim 9, wherein the driving current is determined by a difference between the data voltage and the initiation voltage.

11. The device according to claim 9, wherein the threshold voltage maintained by the condenser compensates a threshold voltage of the second transistor.

12. The device according to claim 9, wherein the power voltage maintained by the condenser compensates a power voltage applied to the second transistor.

13. The device according to claim 9, wherein the first to sixth transistors are PMOS transistors, and the first, fourth, fifth and sixth transistors are controlled by different selection signals.

14. The device according to claim 9, wherein the first to fourth transistors are PMOS transistors, the fifth and sixth transistors are NMOS transistors, the fourth and fifth transistors are complementarily controlled by a first selection signal, and the first and sixth transistors are complementarily controlled by a second selection signal.

15. The device according to claim 9, wherein the first to sixth transistors are PMOS transistors, the first and fourth transistors are controlled by the first selection signal, the fifth transistor is controlled by the second selection signal, and the sixth transistor is controlled by the third selection signal.

16. The device according to claim 9, wherein the first to fifth transistors are PMOS transistors, the sixth transistor is an NMOS transistor, the first and sixth transistors are complementarily controlled by the first selection signal, the fourth transistor is controlled by the first selection signal, and the fifth transistor is controlled by the second selection signal.

17. An organic light-emitting device comprising:

a first transistor for applying an initiation voltage;

a second transistor for applying a power voltage;

a third transistor connected to the first transistor, for generating a threshold voltage;

a first node connected to the second and third transistors; and at least two pixels connected to the first node, wherein each pixel comprises:

a fourth transistor for applying a data voltage;

a fifth transistor for applying a driving current depending on the data voltage and the initiation voltage to an organic light-emitting diode; and a condenser connected between the first node and a second node connected to the fourth and fifth transistors, for maintaining the power voltage and the threshold voltage for compensation.

18. The device according to claim 17, wherein the driving current is determined by a difference between the data voltage and the initiation voltage.

19. The device according to claim 17, wherein the threshold voltage maintained by the condenser compensates a threshold voltage of the second transistor.

20. The device according to claim 17, wherein the power voltage maintained by the condenser compensates a power voltage applied to the fifth transistor.

21. The device according to claim 17, wherein the first and third to fifth transistors are PMOS transistors, the second transistor is an NMOS transistor, the first and second transistors are complementarily controlled by a first selection signal, and the fourth transistor is controlled by a second selection signal.

22. The device according to claim 17, wherein the first to fifth transistors are composed of PMOS transistors, and the first, second and fourth transistors are controlled by different selection signals.

23. The device according to claim 17, wherein the first and third to fifth transistors are PMOS transistors, and the second transistor is an NMOS transistor, and the first and fourth transistors are controlled by the first selection signal, and the second transistor is controlled by the second selection signal, and the first and second selection signals are at the same voltage level.

24. The device according to claim 17, wherein the first to fifth transistors are PMOS transistors, the first and fourth transistors are controlled by the first selection signal, the second transistor is controlled by the second selection signal, and the first and second selection signals are at different voltage levels.

25. An organic light-emitting device comprising:

a first transistor for applying an initiation voltage;

a second transistor for applying a power voltage;

a third transistor connected to the first transistor, for generating a threshold voltage;

a first node connected to the second and third transistors; and at least two pixels connected to the first node, wherein each pixel comprises:

a fourth transistor for applying a data voltage;

a fifth transistor for applying a driving current depending on the data voltage and the initiation voltage to an organic light-emitting diode;

a condenser connected between the first node and a second node connected to the fourth and fifth transistors, for maintaining the power voltage and the threshold voltage for compensation; and a sixth transistor connected between the fifth transistor and the organic light-emitting diode, for cutting off a high current flowing to the organic light-emitting diode during a reset period for which the second node is initialized.

26. The device according to claim 25, wherein the driving current is determined by a difference between the data voltage and the initiation voltage.

27. The device according to claim 25, wherein the threshold voltage maintained by the condenser compensates a threshold voltage of the fifth transistor.

28. The device according to claim 25, wherein the power voltage maintained by the condenser compensates a power voltage applied to the fifth transistor.

29. The device according to claim 25, wherein the first to sixth transistors are PMOS transistors, and the first, fourth, second and sixth transistors are controlled by different selection signals.

30. The device according to claim 25, wherein the first and third to fifth transistors are PMOS transistors, the second and sixth transistor is an NMOS transistor, the first and second transistors are complementarily controlled by a first selection signal, and the fourth and sixth transistors are complementarily controlled by a second selection signal.

31. The device according to claim 25, wherein the first to sixth transistors are PMOS transistors, the first and fourth transistors are controlled by the first selection signal, the second transistor is controlled by the second selection signal, and the sixth transistor is controlled by the third selection signal.

32. The device according to claim 25, wherein the first to fifth transistors are PMOS transistors, the sixth transistor is an NMOS transistor, the fourth and sixth transistors are complementarily controlled by the first selection signal, the first transistor is controlled by the first selection signal, and the second transistor is controlled by the second selection signal.

33. A light-emitting device, comprising:

at least one diode; and a circuit, the circuit inputting a data voltage (Vdata) and an initiation voltage (Vin), the circuit outputting I, wherein $$I=K(\text{Vdata}-\text{Vin})^2$$

where K is a constant, wherein the circuit further comprises:

a first transistor for applying the data voltage;

a second transistor for applying the driving current depending on the data voltage and the initiation voltage to the diode;

a third transistor for generating a threshold voltage;

a fourth transistor for applying the initiation voltage, the fourth transistor being connected to the third transistor;

a fifth transistor for applying a power voltage; and a condenser provided between a first node connected to the third and fifth transistors and a second node connected to the first and second transistors, for maintaining the power voltage and the threshold voltage for compensation.

34. The device according to claim 33, wherein the driving current is determined by a difference between the data voltage and the initiation voltage.

35. The device according to claim 33, wherein the threshold voltage maintained by the condenser compensates a threshold voltage of the second transistor.

36. The device according to claim 33, wherein the power voltage maintained by the condenser compensates a power voltage applied to the second transistor.

37. The device according to claim 33, wherein the first to fourth transistors are PMOS transistors, the fifth transistor is an NMOS transistor, the fourth and fifth transistors are complementarily controlled by a first selection signal, and the first transistor is controlled by a second selection signal.

38. The device according to claim 33, wherein the first to fifth transistors are PMOS transistors, and the first, fourth and fifth transistors are controlled by different selection signals.

39. The device according to claim 33, wherein the first to fourth transistors are PMOS transistors, the fifth transistor is an NMOS transistor, the first and fourth transistors are controlled by the first selection signal, the fifth transistor is controlled by the second selection signal, and the first and second selection signals are at the same voltage level.

40. The device according to claim 33, wherein the first to fifth transistors are PMOS transistors, the first and fourth transistors are controlled by the first selection signal, the fifth transistor is controlled by the second selection signal, and the first and second selection signals are at different voltage levels.

* * * * *